US006084342A

United States Patent [19]

Ragland, Jr.

[11] Patent Number: 6,084,342

[45] Date of Patent: Jul. 4, 2000

[54] COLOR PICTURE TUBE HAVING A TENSIONED MASK-SUPPORT FRAME ASSEMBLY

[75] Inventor: Frank Rowland Ragland, Jr., Lancaster, Pa.

[73] Assignee: Thomson Licensing S.A., Boulogne Cedex, France

[21] Appl. No.: 09/112,109

[22] Filed: Jul. 8, 1998

[51] Int. Cl.[7] ..... H01J 29/80

[52] U.S. Cl. ..... 313/407; 313/402

[58] Field of Search ..... 313/407, 402

[56] References Cited

U.S. PATENT DOCUMENTS 5,041,756 8/1991 Fairbanks ..... 313/407
5,113,111 5/1992 Fairbanks ..... 313/404
5,594,300 1/1997 Nosker et al. ..... 313/402
5,644,192 7/1997 Ragland, Jr. ..... 313/402

FOREIGN PATENT DOCUMENTS

WO98/48439 10/1998 WIPO .

*Primary Examiner*—Vip Patel
*Attorney, Agent, or Firm*—Joseph S. Tripoli; Dennis H. Irlbeck

[57] ABSTRACT

An improved color picture tube has a tensioned mask and support frame assembly. Each of the mask and the support frame is rectangular and has two long sides that parallel a central major axis thereof and two short sides that parallel a central minor axis thereof. The improvement comprises the frame including two first members, paralleling the major axis, and two second members, attached to the ends of said first members, paralleling the minor axis. Each of the second members includes a pinched section that elongates it.

3 Claims, 3 Drawing Sheets

COLOR PICTURE TUBE HAVING A TENSIONED MASK-SUPPORT FRAME ASSEMBLY

This invention relates to color picture tubes having masks, and particularly to a tube with a mask-frame assembly having a tensioned mask that is attached to a support frame.

BACKGROUND OF THE INVENTION

A color picture tube includes an electron gun for generating and directing three electron beams to a screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is contoured to somewhat parallel the inner surface of the tube faceplate. A focus mask comprises dual sets of conductive lines that are perpendicular to each other and usually separated by an insulative layer.

One type of color picture tube has a tensioned shadow mask mounted within a faceplate panel thereof. In order to maintain the tension on the mask, the mask must be attached to a relatively massive support frame. Although such tubes have found wide consumer acceptance, there is still a need for further improvement in tube types to reduce the weight and cost of the mask-frame assemblies in such tubes, and to simplify the process of maintaining tension in the mask following high temperature processing.

SUMMARY OF THE INVENTION

The present invention provides an improvement in a color picture tube having a tensioned mask and support frame assembly. Each of the mask and the support frame is rectangular and has two long sides that parallel a central major axis thereof and two short sides that parallel a central minor axis thereof. The improvement comprises the frame including two first members paralleling the major axis and two second members, attached to the ends of the first members, paralleling the minor axis. Each of the second members includes a pinched section that elongates the member.

DETAILED DESCRIPTION OF THE PREFERRED EMBODIMENTS

Figure 1:
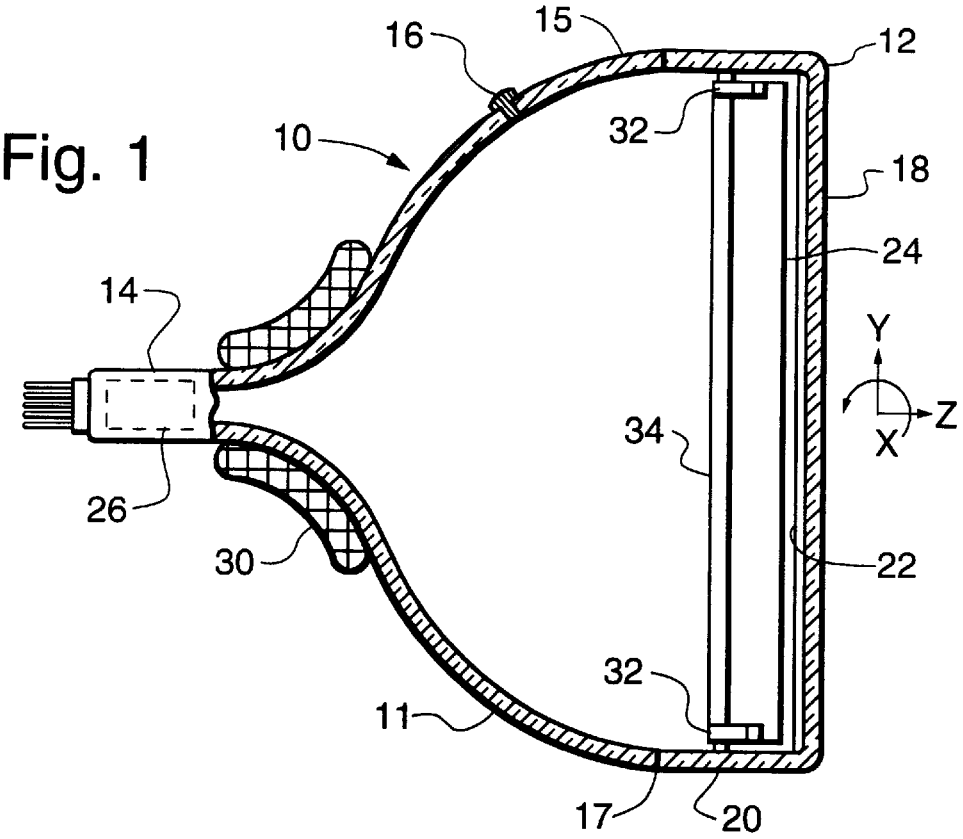
FIG. 1 is a side view, partly in axial section, of a color picture tube embodying the invention.

FIG. 1 shows a color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a substantially cylindrical viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection electrode or tensioned mask 24 is removably mounted in predetermined spaced relation to the screen 22. The tensioned mask 24 may be either a shadow mask or a focus mask. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
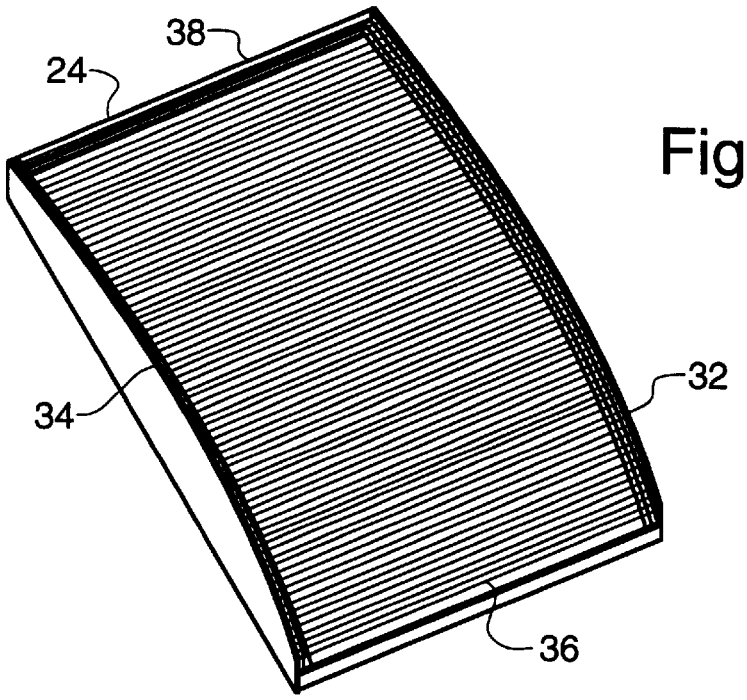
FIG. 2 is a perspective view of a tensioned shadow mask-frame assembly.
Figure 3:
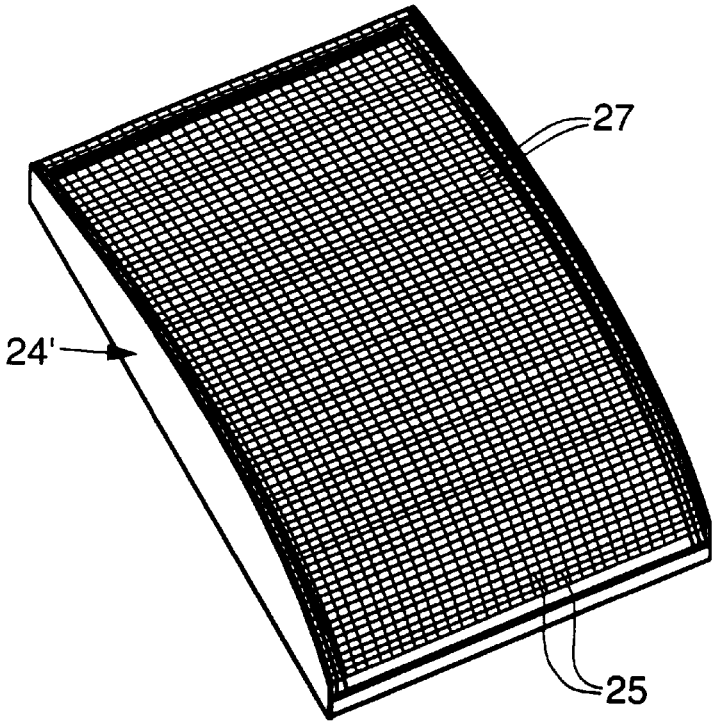
FIG. 3 is a perspective view of a tensioned focus mask-frame assembly.

The tensioned mask, shown in the form of a tensioned shadow mask 24 in FIG. 2, includes two long sides 32 and 34, and two short sides 36 and 38. The two long sides 32 and 34 of the mask parallel a central major axis, X, of the mask; and the two short sides 36 and 38 parallel a central minor axis, Y, of the mask. The tensioned shadow mask 24 of FIG. 2 includes an apertured portion that contains a multiplicity of elongated slits that parallel the minor axis of the mask. Each slit extends from near one long side of the mask to near the other long side. Another form of tensioned mask is a tensioned focus mask 24', shown in FIG. 3. The tensioned focus mask 24' includes dual sets of conductive lines 25 and 27 that are perpendicular to each other and separated by an insulative layer (not shown).

Figure 4:
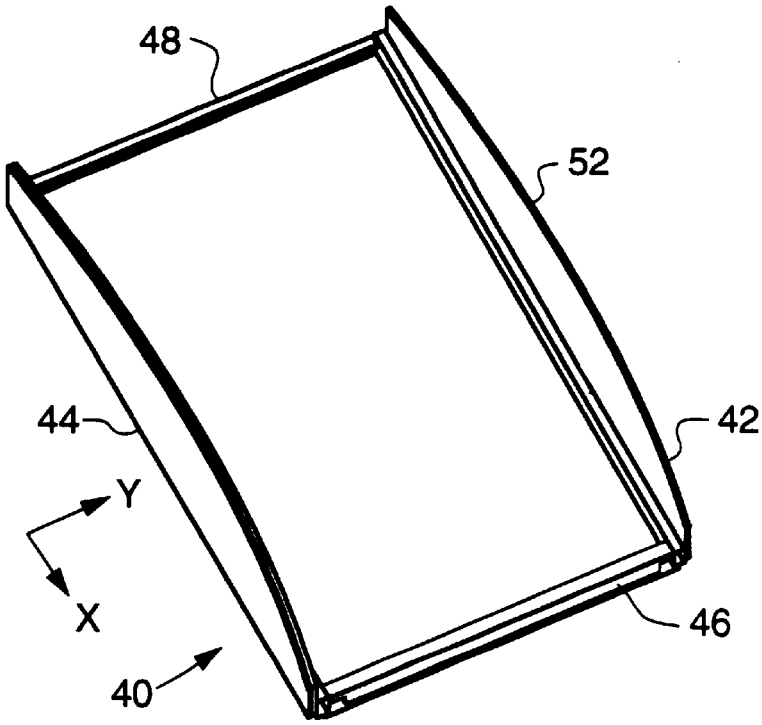
FIG. 4 is a perspective view of a mask frame.
Figure 5:
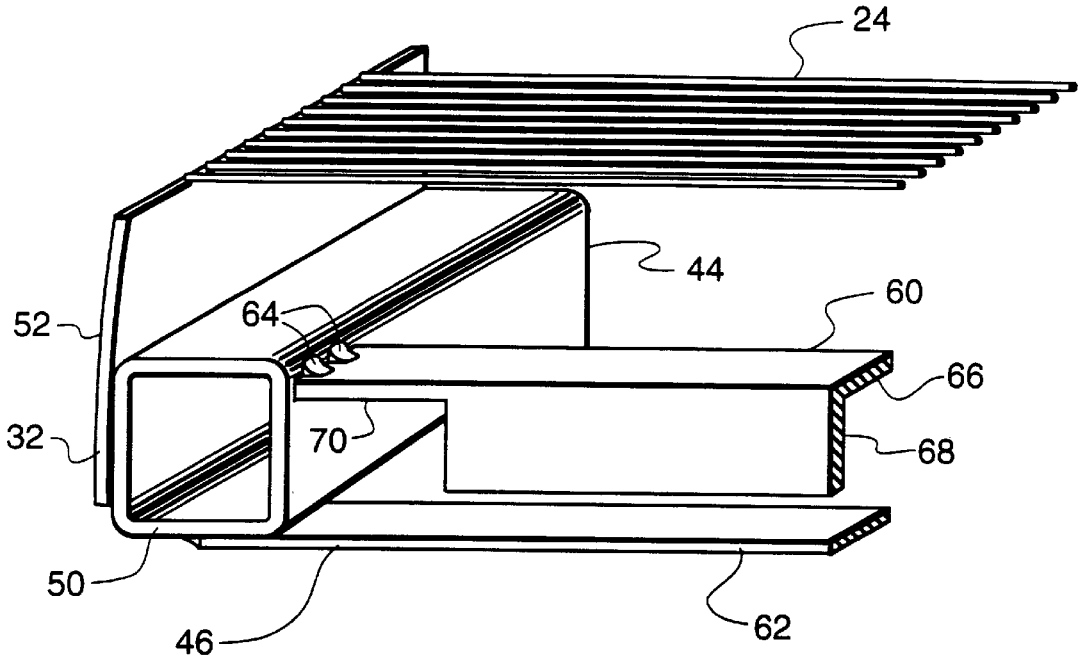
FIG. 5 is a partial perspective view of the mask-frame assembly of FIG. 2.
Figure 6:
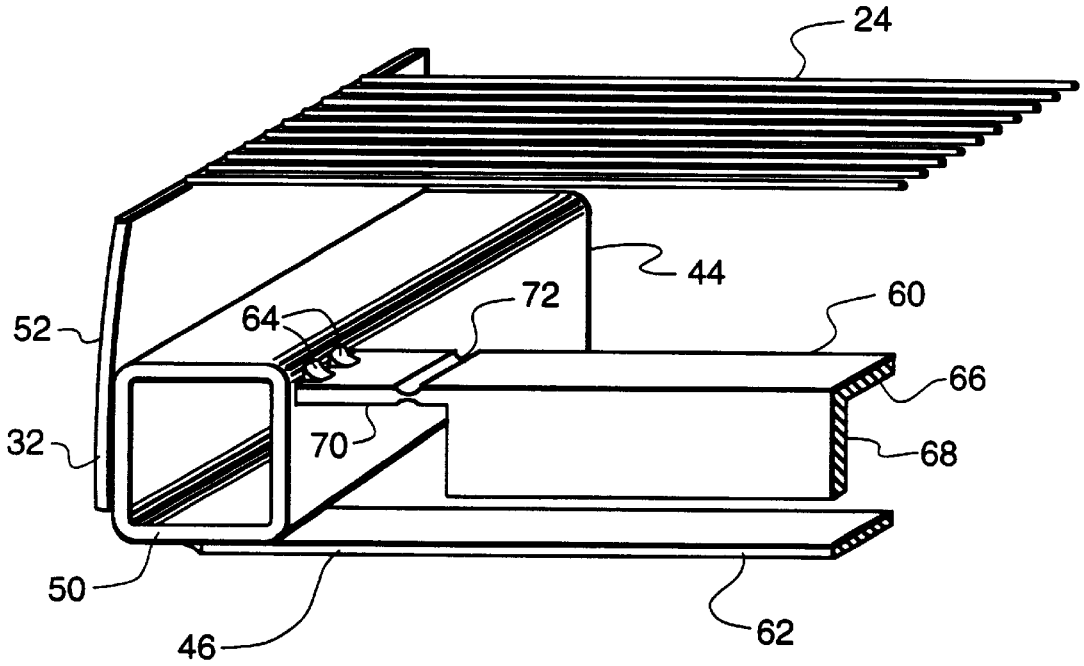
FIG. 6 is a partial perspective view of the mask-frame assembly of FIG. 5 after further processing.

A frame 40, for use with either the tensioned shadow mask 24 or the tensioned focus mask 24', is shown in FIG. 4. The frame 40 includes four sides: two long sides 42 and 44, substantially paralleling the major axis X of the tube, and two short sides 46 and 48, paralleling the minor axis Y of the tube. As shown in greater detail in FIGS. 5 and 6, each of the two sides 42 and 44 includes a rigid section 50 and a compliant section 52 cantilevered from the rigid section. The rigid sections 50 are hollow tubes, and the compliant sections 52 are metal plates. The compliant sections 52 vary in height from the center of each section longitudinally to the ends of the sections, to permit the best tension compliance over the mask. Each of the short sides 46 and 48 has an L-shaped cross-section upper portion 60 parallel to and separated from a flat bar-shaped lower portion 62. The two long sides of the tension mask 24 are welded to the distal ends of the compliant sections 52. Each short side upper portion 60 is welded at each end to the rigid sections 50 of the longs sides at sufficient points 64 to assure that it is rigidly attached. The short side lower portions 62 are firmly welded to the bottoms of both of the rigid sections 50. The upper portion has two flanges, 66 and 68, at a right angle to each other. The flange 66 is perpendicular to the central longitudinal Z axis, and the flange 68 parallels the Z axis. Preferably, at one end of the upper portion 60, the flange 66 extends beyond the flange 68, so that, at that one end, only the flange 66 contacts and is welded to a rigid section 50. The part 70 of the flange 66 that extends beyond the flange 68 provides a location that can be used to increase the tension on the mask 24, which may have been decreased by exposures to high temperatures during processing of the mask-frame assembly. Following such processing, the part 70 is stretched by some mechanical means, such as a preferred method of pinching the part 70 with a suitable pinching device. The width and depth of the pinch controls the elongation of the part 70. Additionally, the pinch may be in both surfaces of the part 70, as shown in FIG. 6 by the pinch 72, or confined to one surface. Also, the part 70 may be included in both ends of the flange 66, or in an intermediate portion thereof. The mask-frame assembly with the part 70 pinched, is shown in FIG. 6. For present purposes, pinching is the pressing against a metal to compress and elongate the metal.

In one preferred embodiment, the rigid sections 50 of the long side members 42 and 44 are hollow square tubes of 4130 steel having a wall thickness of 0.175 cm. The thickness of the compliant sections 52 is determined by considering mask thickness, the flexibility of the total mask-frame assembly and the desired warp misregistration limits. In a further preferred embodiment, the compliant sections 52 are plates of 4130 stainless steel that are 0.157 cm thick. The compliant sections 52 also can be bimetal plates, such as of stainless steel/stainless steel or stainless steel/Invar. The two upper portions 60 are preferably of CRS-1018 steel having a thickness of 0.318 cm. The two lower portions 62 are preferably of 300 Series stainless steel, which has a different coefficient of thermal expansion than does the CRS-1018 steel of the upper portions 60. When the frame 40 is heated, the lower portions 62 expand more than do the upper portions 60. Because of the flexible connections between the straight and curved members, the differential expansion between the lower portions 62 and the upper portions 60 relieves stress in the compliant sections 52 and tension in the mask 24 during high temperature processing.

Although the rigid sections 50 have been shown as hollow square tubes, other preferred configurations, such as those having L-shaped, C-shaped or triangular-shaped cross-sections, are also possible for these sections. Furthermore, although the short sides 46 and 48 have been shown as having L-shaped cross-sections, other preferred configurations may be C-shaped, triangular shaped or box-shaped.

What is claimed is:

1. In a color picture tube having a tensioned mask-support frame assembly, each of said mask and said support frame being rectangular and having two long sides paralleling a central major axis thereof and two short sides paralleling a central minor axis thereof, the improvement comprising said frame including two first members, paralleling the major axis, and two second members, attached to the ends of said first members, paralleling the minor axis, each of said second members including a pinched section.

2. The color picture tube as defined in claim 1, wherein said second member includes two parallel separated portions, one of said parallel separated portions including said pinched section.

3. The color picture tube as defined in claim 2, wherein said portion including a pinched section has an L-shaped cross-section formed by two flanges, a first of said flanges extending beyond a second of said flanges toward a first member, and said pinched section being a part of the first flange extension.

* * * * *